US007959030B2

(12) United States Patent
Bergman

(10) Patent No.: US 7,959,030 B2
(45) Date of Patent: Jun. 14, 2011

(54) ROLLER BRUSH ADAPTABLE HAND-HELD CONTAINER HAVING SIDEWALL RAMP PORTION

(75) Inventor: Mark W. Bergman, Minnetonka, MN (US)

(73) Assignee: Bercom International, LLC, Chanhassen, MN (US)

( * ) Notice: Subject to any disclaimer, the term of this patent is extended or adjusted under 35 U.S.C. 154(b) by 694 days.

(21) Appl. No.: 11/118,659

(22) Filed: Apr. 29, 2005

(65) Prior Publication Data

US 2006/0243732 A1 Nov. 2, 2006

(51) Int. Cl.
*B05C 21/00* (2006.01)

(52) U.S. Cl. ..... 220/769; 220/570; 220/631; 220/755; 220/756; 220/768; 220/771; 220/772

(58) Field of Classification Search ..... 220/495.02, 220/570, 631, 669, 674, 675, 753, 755–757, 220/760, 762–766, 768, 769, 771, 772, 774; 222/470–472; 280/47.17, 47.26, 47.31; D34/5, D34/10

See application file for complete search history.

(56) References Cited

U.S. PATENT DOCUMENTS

| | | | | |
|---|---|---|---|---|
| 119,666 | A * | 10/1871 | Stuart | 220/765 |
| D24,803 | S | 10/1895 | Linn et al. | D6/420 |
| 1,014,475 | A * | 1/1912 | Holloway | 280/47.26 |
| 1,304,415 | A | 5/1919 | Tucker | |
| 1,590,572 | A | 6/1926 | Fredette | |
| 1,734,976 | A | 11/1929 | McClellan | |
| 1,813,670 | A | 7/1931 | Kessler | |
| 1,950,505 | A | 3/1934 | Matters | |
| 2,228,536 | A | 1/1941 | Scalph | |
| 2,626,737 | A | 1/1953 | Pitz | |
| 2,661,858 | A | 12/1953 | Howell | |
| 2,709,540 | A | 5/1955 | Kenney | |
| 2,712,668 | A | 7/1955 | Thiele | |
| D175,865 | S | 10/1955 | Stone | |
| 2,765,969 | A | 10/1956 | Bennington | |
| D184,315 | S | 1/1959 | Jennings et al. | |
| 3,014,621 | A | 12/1961 | Povitz | 222/183 |
| 3,138,280 | A | 6/1964 | Shafer | |

(Continued)

FOREIGN PATENT DOCUMENTS

GB 195523 4/1923

(Continued)

OTHER PUBLICATIONS

Illustration (from Sporty's website showing a "Painter's Helper" ID#: 1610T) of the paint container manufactured by Aqua-Trainer Co., of Shorewood, Illinois, (Published prior to Apr. 29, 2005).

14 photos of a pail known to the public prior to Apr. 29, 2004 (14 pages).

Office Action from the U.S. Patent and Trademark Office for U.S. Appl. No. 29/288,282, dated Oct. 1, 2009 (14 pages).

Response for U.S. Appl. No. 29/288,282, dated Jan. 26, 2010 (4 pages).

Office Action from the U.S. Patent and Trademark Office for U.S. Appl. No. 29/288,282, dated Jun. 7, 2010 (17 pages).

Complaint for Patent Infringement (Jury Trial Demanded); *Prime Source Associates, Ltd.* v. *Books-A-Million, Inc.*, in the United States District Court—Southern District of Florida; Case No. 10-14056-CV-Graham/Lynch; filed Feb. 22, 2010 (17 pages).

*Primary Examiner* — Anthony Stashick
*Assistant Examiner* — Ned A Walker
(74) *Attorney, Agent, or Firm* — Westman, Champlin & Kelly

(57) ABSTRACT

The present invention is a container comprising a bottom wall having an outer surface and an inner surface, a sidewall extending from the bottom wall, and a handle. The sidewall has a top section and a bottom section, a front section and a rear section, and an outer surface and an inner surface. The inner surface of the sidewall comprises a base portion extending from the inner surface of the bottom wall and a ramp portion extending at an acute angle from the base portion at the front section of the sidewall. The handle is connected to the outer surface of the sidewall adjacent both the top section and the rear section of the sidewall.

13 Claims, 9 Drawing Sheets

U.S. PATENT DOCUMENTS 3,139,646 A 7/1964 Vernon
D202,134 S * 8/1965 Bryan ..... D32/53.1
3,219,233 A 11/1965 Whiteford
3,229,820 A 1/1966 Hentzi et al.
3,292,815 A 12/1966 Smith et al. ..... 220/94
3,311,252 A 3/1967 Swartwood et al.
3,341,876 A 9/1967 Campbell
3,346,271 A * 10/1967 Parsons ..... 280/33.998
3,351,970 A 11/1967 Engh
3,425,012 A 1/1969 Gottinger
D216,277 S 12/1969 James
3,536,285 A 10/1970 Vaughn
3,590,416 A 7/1971 Henningsen
3,595,431 A 7/1971 Bird
3,602,939 A 9/1971 Schoenholz
D223,864 S 6/1972 Vines
3,682,352 A 8/1972 Douchette
3,707,242 A 12/1972 Golden et al. ..... 220/1 R
3,729,158 A 4/1973 Nagy
3,752,494 A * 8/1973 Dunn ..... 280/47.26
3,828,389 A 8/1974 Heisler
3,940,824 A 3/1976 Gioia et al.
4,061,242 A 12/1977 Donlon
4,094,431 A * 6/1978 Wheeler ..... 220/23.4
4,101,046 A 7/1978 Puntillo
4,102,468 A * 7/1978 Goldman ..... 220/630
4,106,434 A * 8/1978 Vines ..... 118/258
4,145,789 A 3/1979 Morgan, Sr.
4,164,299 A 8/1979 Fuhr
D254,482 S 3/1980 Bell
4,297,762 A * 11/1981 Crysdale ..... 15/257.06
D277,080 S 1/1985 Gagnon
4,509,226 A * 4/1985 Allison et al. ..... 15/257.06
4,519,565 A 5/1985 Whitmore
4,627,546 A 12/1986 Carranza ..... 215/100 A
4,691,840 A 9/1987 Ferbrache
D292,638 S * 11/1987 Carville ..... D34/5
4,726,485 A * 2/1988 Bailey ..... 220/6
D299,578 S * 1/1989 Wilson ..... D34/25
4,798,307 A 1/1989 Evrard
4,860,891 A 8/1989 Biggio
4,895,269 A 1/1990 Cade
4,927,046 A 5/1990 Armstrong
4,928,873 A 5/1990 Johnson
4,953,744 A * 9/1990 Koyama ..... 220/495.11
5,011,536 A 4/1991 Boom
5,033,704 A 7/1991 Kerr
5,083,733 A 1/1992 Marino et al.
D323,912 S * 2/1992 Delmerico ..... D34/5
5,092,481 A 3/1992 Skelton
5,139,139 A * 8/1992 Goetz ..... 206/229
5,147,067 A 9/1992 Effertz
D330,103 S * 10/1992 Andrews et al. ..... D34/20
5,169,025 A 12/1992 Guo
5,201,439 A * 4/1993 Davies ..... 220/735
5,203,471 A * 4/1993 Widman ..... 220/755
5,207,348 A 5/1993 Fischer et al.
5,222,656 A 6/1993 Carlson
5,251,780 A * 10/1993 Lee ..... 220/630
D343,490 S * 1/1994 Ramsey ..... D34/5
5,308,181 A 5/1994 Hull et al. ..... 401/206
5,314,061 A * 5/1994 Bedrossian ..... 206/229
5,320,249 A 6/1994 Strech
5,322,183 A 6/1994 Strachan ..... 220/697
5,341,969 A * 8/1994 Accardo et al. ..... 222/465.1
D350,632 S 9/1994 Cummins
D353,697 S * 12/1994 Breen et al. ..... D34/10
D353,727 S * 12/1994 Sun ..... D6/440
5,400,916 A 3/1995 Weber
5,429,262 A 7/1995 Sharkey
5,493,751 A 2/1996 Misiukowiec et al.
5,509,169 A * 4/1996 Drucker ..... 15/257.06
5,511,279 A 4/1996 Ippolito
5,538,158 A * 7/1996 Prout et al. ..... 220/771
5,547,104 A * 8/1996 Parker ..... 220/772
5,549,216 A 8/1996 Scholl
5,570,807 A 11/1996 Busch
5,582,322 A * 12/1996 Prout et al. ..... 220/771
5,624,093 A 4/1997 Gemmell
5,641,087 A 6/1997 Moffitt
D389,626 S 1/1998 Lundy ..... D32/53
5,746,346 A 5/1998 Crilly
5,776,405 A * 7/1998 Prout et al. ..... 264/310
D397,833 S 9/1998 Zurawin
5,810,196 A 9/1998 Lundy
RE35,933 E 10/1998 Scholl
D401,116 S 11/1998 Demore
5,836,469 A 11/1998 Zebrowski
D402,643 S 12/1998 Grassel ..... D14/114
D404,870 S * 1/1999 Van Rhienen ..... D34/16
5,899,468 A * 5/1999 Apps et al. ..... 280/47.26
5,971,201 A 10/1999 Daw
D422,450 S 4/2000 Conti
6,053,354 A * 4/2000 Niemeyer ..... 220/819
6,062,389 A 5/2000 Kent ..... 206/518
6,065,633 A 5/2000 Abbey
6,105,813 A * 8/2000 Abbey ..... 220/570
6,119,303 A 9/2000 Passafiume
6,138,963 A 10/2000 Malvasio
6,145,856 A * 11/2000 Conti ..... 280/47.26
D435,728 S 1/2001 Miles et al.
6,193,265 B1 * 2/2001 Yemini ..... 280/653
D444,929 S 7/2001 Cox
6,260,730 B1 7/2001 Fellman
6,276,554 B1 8/2001 Lallement et al.
D452,130 S 12/2001 Richardson
D458,723 S 6/2002 Malvasio ..... D32/53.1
D460,845 S 7/2002 Bergman
6,419,106 B1 7/2002 Bebak
D462,838 S * 9/2002 Van Landingham ..... D3/304
6,446,829 B1 9/2002 Malvasio et al.
D464,259 S 10/2002 Bianco ..... D9/761
D466,407 S 12/2002 Nance
D466,787 S 12/2002 Clancy
D467,784 S 12/2002 Maier
D477,702 S 7/2003 Kohn ..... D32/53
D478,197 S * 8/2003 Raghunathan ..... D34/5
6,622,340 B2 * 9/2003 Rosa ..... 15/257.06
D482,274 S 11/2003 Walsh
D482,830 S 11/2003 Kohn ..... D32/53.1
D483,917 S 12/2003 Frantz ..... D32/53.1
6,708,838 B2 3/2004 Bergman et al.
D493,035 S 7/2004 Bergman
D499,027 S 11/2004 Walsh et al.
D499,575 S 12/2004 Chan ..... D6/406.3
6,827,233 B1 * 12/2004 Scallate ..... 220/603
6,880,852 B2 * 4/2005 Lim ..... 280/653
D509,420 S 9/2005 Hauber
D512,245 S 12/2005 Bean et al. ..... D6/406.3
6,991,829 B2 1/2006 Bergman ..... 427/429
D517,833 S 3/2006 Jennings ..... D6/406.5
D518,263 S 3/2006 Verhaar
D535,794 S 1/2007 Lundy et al.
D549,913 S 8/2007 Bergman
D575,077 S 8/2008 Kessels ..... D6/406.3
D583,163 S 12/2008 Jennings ..... D6/406.6
2001/0013518 A1 * 8/2001 Lallement et al. ..... 220/570
2002/0036206 A1 3/2002 Bergman et al.
2002/0056714 A1 5/2002 Schinkel
2004/0007574 A1 * 1/2004 Most et al. ..... 220/23.4
2004/0118861 A1 6/2004 Bergman et al. ..... 220/756
2004/0173622 A1 9/2004 Findleton
2004/0195248 A1 10/2004 Garcia ..... 220/570
2004/0206761 A1 10/2004 Frantz ..... 220/570
2004/0208083 A1 10/2004 Armendariz et al.
2004/0256335 A1 12/2004 Sholem ..... 211/70.6
2005/0161462 A1 * 7/2005 Bergman ..... 220/757

FOREIGN PATENT DOCUMENTS

JP 10 287339 10/1998

* cited by examiner

ROLLER BRUSH ADAPTABLE HAND-HELD CONTAINER HAVING SIDEWALL RAMP PORTION

BACKGROUND

The present invention relates to containers for holding fluids. In particular, the present invention relates to a hand-held container with an inner surface adapted for use with roller brushes.

Hand-held vessels, containers, or trays are utilized for carrying a variety of materials or fluids. Typically, a handle is provided, which allows a user to carry or hold the container without the user contacting the fluid therein. This is particularly beneficial in the case when the fluid is toxic or hazardous to a person's skin. A portable, hand-held container is useful in many commercial or household applications, and is especially useful in painting applications.

In the field of painting, there has long been a problem as to how to comfortably hold and carry a quantity of paint and a tool (e.g., a paintbrush or roller brush) for an extended period of time and on an unstable surface, such as while climbing a ladder, working off of a scaffold, or while standing on the roof of a building. One approach to this problem has been to use a light-weight paper bucket capable of holding around a gallon of paint. These buckets, however, have no handle and must be gripped with the thumb and fingers by the rim and side, which is tiring, or they must be cradled against a user's body (e.g., in the crook of a user's arm) which is awkward and inconvenient.

Another approach to the problem is to use a conventional bucket with a bail-type handle. This approach, while affording a more versatile mode of holding a paint bucket, is awkward for dipping a tool into the paint when the bucket is being suspended from the handle since the handle and the user's hand tends to be in the way. This is particularly true for roller brushes, which tend to be larger than conventional paintbrushes.

Tray-type containers are typically used with roller brushes, due to their wide openings and textured surfaces suitable for rolling the roller brushes. However, tray containers are difficult to carry, thereby increasing the likelihood of inadvertently spilling paint during the painting process.

Accordingly, readily-portable conventional hand-held containers are difficult to hold in close proximity to the user's other hand or work area without exerting considerable effort. As such, there is a need for a comfortable, stable, and secure hand-held container for retaining, holding, and dispensing fluids or other loose materials, without exerting considerable effort.

SUMMARY

The present invention is a container comprising a bottom wall having an outer surface and an inner surface, a sidewall extending from the bottom wall, and a handle. The sidewall has a top section and a bottom section, a front section and a rear section, and an outer surface and an inner surface. The handle is connected to the outer surface of the sidewall adjacent both the top section and the rear section of the sidewall. The inner surface of the sidewall comprises a base portion extending from the inner surface of the bottom wall and a ramp portion extending at an acute angle from the base portion at the front section of the sidewall.

In one embodiment, the present invention is characterized as a container comprising a bottom wall having an outer surface and an inner surface, a sidewall extending from the bottom wall, and a handle. The sidewall has an outer surface and an inner surface, where the inner surfaces of the bottom wall and the sidewall define a cavity. The handle is connected to the outer surface of the sidewall such that the handle is not disposed over the cavity. The inner surface of the sidewall comprises a base portion extending from the inner surface of the bottom wall and a ramp portion extending at an acute angle from the base portion.

In yet another embodiment, the invention is characterized as a container comprising a bottom wall having an inner surface, a rim portion separated from the bottom wall along a first coordinate direction, a sidewall connecting the bottom wall and the rim portion, and a handle. The rim portion has a front section and a rear section separated along a second coordinate direction, where the second coordinate direction, is perpendicular to the first coordinate direction. The handle is connected to the top rim adjacent the rear section of the rim portion. The sidewall has an inner surface comprising a base portion extending from the inner surface of the bottom wall, a ramp portion extending at an acute angle from the base portion, and a lip portion adjacent the rim portion, where the lip portion extends at a second acute angle from the ramp portion.

The above summary is not intended to describe each disclosed embodiment or every implementation of the present invention. The figures and the detailed description that follow more particularly exemplify illustrative embodiments.

While the above-identified drawings set forth one embodiment of the invention, other embodiments are also contemplated, as noted in the discussion. In all cases, this disclosure presents the invention by way of representation and not limitation. It should be understood that numerous other modifications and embodiments may be devised by those skilled in the art, which fall within the scope and spirit of the principles of the invention. The figures may not be drawn to scale. Like reference numbers have been used throughout the figures to denote like parts.

DETAILED DESCRIPTION

Figure 1:
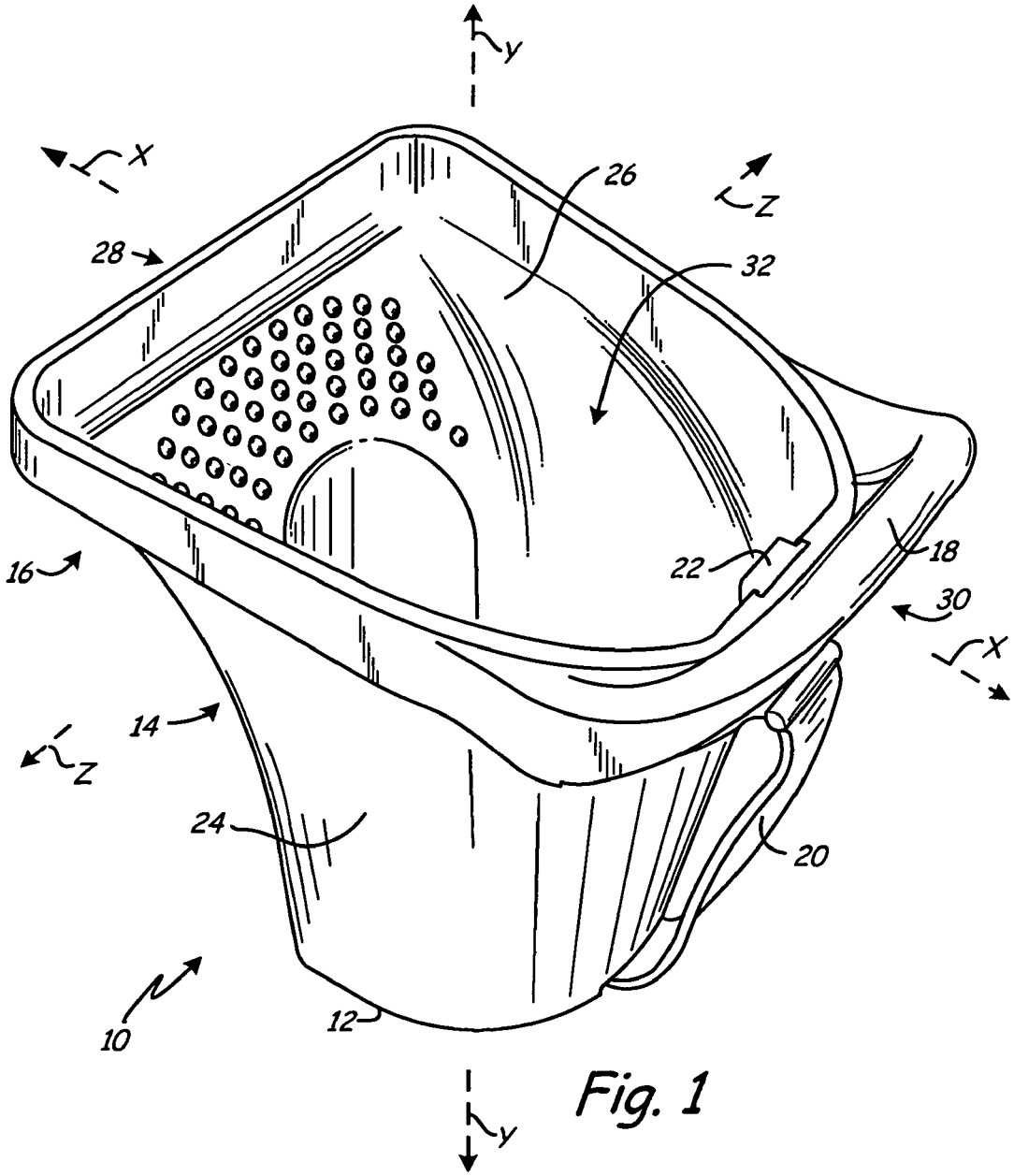
FIG. 1 is a rear perspective view of a container of the present invention.

FIG. 1 is a rear perspective view of container 10 of the present invention, which is a hand-held container that provides a convenient means for retaining, transporting, and dispensing fluids. Container 10 includes bottom wall 12, sidewall 14, rim portion 16, handle 18, strap 20, and magnet 22. As used herein, front and rear sections of container 10 are spaced apart along coordinate direction X, top and bottom sections of container 10 are spaced apart along coordinate direction Y, and lateral sections (e.g., left/right) of container 10 are spaced apart along coordinate direction Z, where coordinate directions X, Y, and Z are each perpendicular to each other in a Cartesian coordinate system.

Bottom wall 12 is a container base that allows container 10 to rest in an upright position on a horizontal surface. Sidewall 14 extends upward from bottom wall 12, and includes outer surface 24, inner surface 26, top front section 28, and top rear section 30. Outer surface 24 and inner surface 26 are the opposing major surfaces of sidewall 14. Top front section 28 is a top front portion of sidewall 14. Similarly, top rear section 30 is a top rear portion of sidewall 14. As discussed below, inner surface 26 and an inner surface of bottom wall 12 (not shown in FIG. 1) define cavity 32 of container 10 for retaining fluids. Rim portion 16 is a top portion of sidewall 14, and defines an opening to cavity 32. This allows a user to insert and remove tools, such as paintbrushes and roller brushes, through cavity 32.

Handle 18 extends from outer surface 24 of sidewall 14 at rim portion 16, and is disposed adjacent top rear section 30 of sidewall 14. This provides a convenient gripping location, which extends rearwardly from top rear section 30. Strap 20 provides a second approach for holding and carrying container 10, in addition to handle 18. Strap 20 is connected to sidewall 14 adjacent top rear section 30 and is connectable to bottom wall 12. As discussed below, strap 20 is adaptable to accept a user's hand disposed between strap 20 and outer surface 24 of sidewall 14.

Magnet 22 is disposed within cavity 32, and is connected to inner surface 26 of sidewall 14, adjacent a rear portion of rim portion 16. Magnet 22 is suitable for releasably holding a tool, such as a paintbrush or a roller brush, within cavity 32. In other embodiments of the present invention, container 10 may alternatively incorporate other mechanisms for retaining tools within cavity 32. For example, rim portion 16 may include a notch, which is formed to accommodate and even retain the handle of a tool.

Bottom wall 12, sidewall 14, rim portion 16, and handle 18 may be cast or molded from a variety of materials, such as plastics and metals, using conventional manufacturing techniques. Suitable plastics include polypropylene and other plastics capable of withstanding the harmful effects of paint, stain, and varnish. In the embodiment shown in FIG. 1, bottom wall 12, sidewall 14, rim portion 16, and handle 18 are integrally formed as a single rigid component to provide a continuous interior surface for containing fluids. However, in other embodiments, one or more of bottom wall 12, sidewall 14, rim portion 16, and handle 18 may be separately formed components that are connected to provide container 10. Because of their rigid nature, bottom wall 12, sidewall 14, rim portion 16, and handle 18 do not substantially deform during use. As such, container 10 is suitable for retaining and transporting heavy amounts of fluid or loose materials, such as large volumes of paint.

Figure 2:
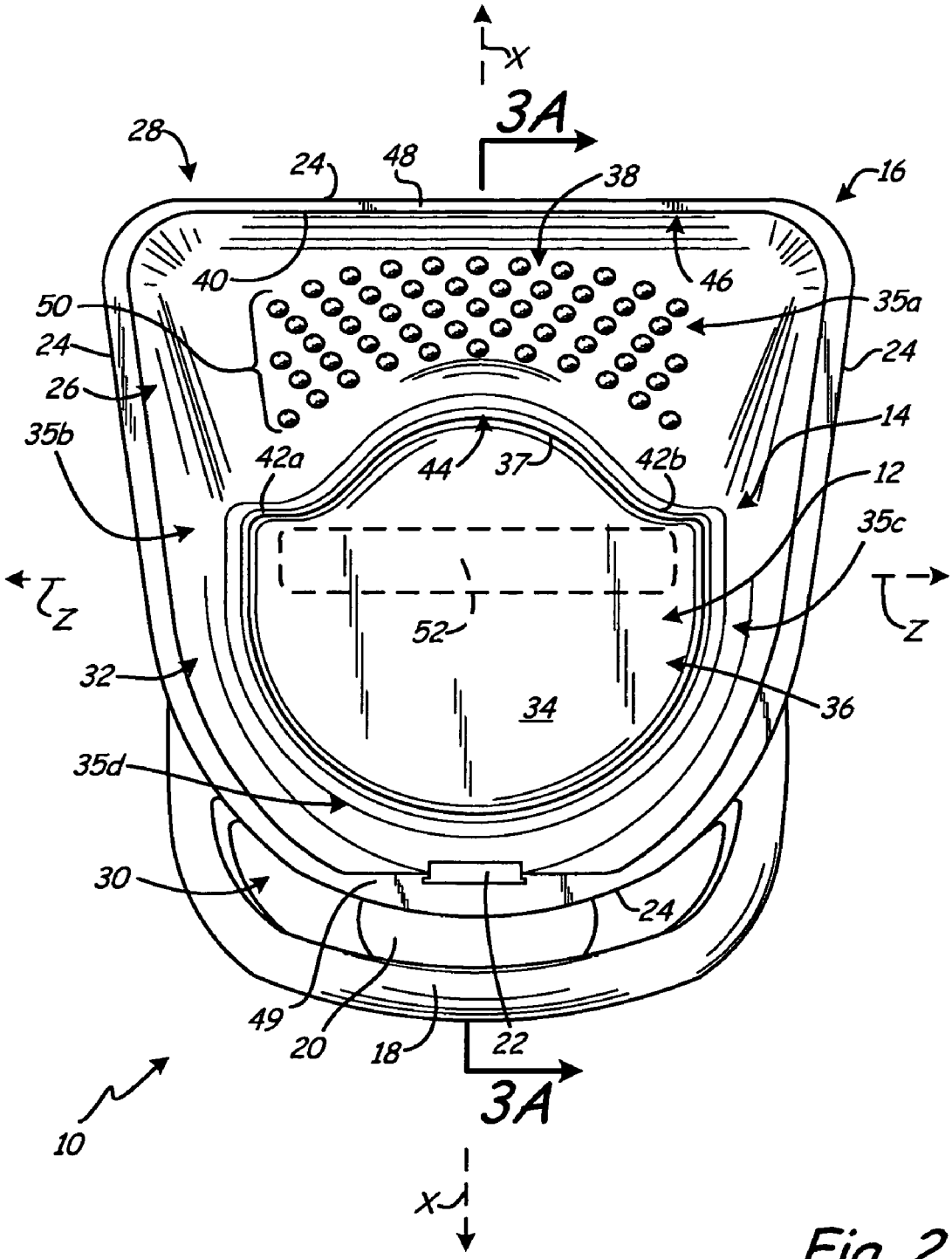
FIG. 2 is a top view of the container of the present invention.

FIG. 2 is a top view of container 10, further illustrating cavity 32. As shown, bottom wall 12 includes inner surface 34. Inner surface 26 of sidewall 14 extends upward from inner surface 34 around an entire inner periphery of sidewall 14, and ends at the top of container 10, adjacent rim portion 16. As such, inner surfaces 26 and 34 define cavity 32, as discussed above. Inner surface 26 includes front surface 35*a*, right surface 35*b*, left surface 35*c*, and rear surface 35*d*, where the terms "left" and "right" are taken relative to a front view of container 10. Right surface 35*b*, left surface 35*c*, and rear surface 35*d* generally extend upward from inner surface 34 of bottom wall 12 in a generally straight manner, showing little curvature in a direction along coordinate direction Y. The portions of front surface 35*a*, right surface 35*b*, left surface 35*c*, and rear surface 35*d* extending around an entire lower periphery of cavity 32 define bottom section 36 of cavity 32.

Front surface 35*a* of inner surface 26 includes base portion 37, ramp portion 38, lip portion 40, and side rails 42*a* and 42*b*. Base portion 37 and side rails 42*a* and 42*b* are the portions of inner surface 26 that extend upward from inner surface 34 of base wall 12 at the front of container 10, adjacent bottom section 36. As shown in FIG. 2, base portion 37 is an inverted U-shaped indentation between side rails 42*a* and 42*b*. Ramp portion 38 extends at an angle from base portion 37 at first corner 44, which is adjacent top front section 28 of sidewall 14. Ramp portion 38 also extends at a gradual angle from each of side rails 42*a* and 42*b*. The gradual angles between side rails 42*a*/42*b* and ramp portion 38 are generally less severe than the angle between base portion 37 and ramp portion 38. Lip portion 40 extends at an angle from ramp portion 38 at second corner 46, which is also adjacent top front section 28 of sidewall 14.

Because ramp portion 38 extends at an angle to bottom portion 36 and side rails 42*a* and 42*b*, a top section 47 of cavity 32 (best shown in FIG. 3A) has a cross-sectional area at rim portion 16 that is greater than a cross-sectional area at inner surface 34, where the cross-sectional areas are taken in a plane defined by coordinate direction X and coordinate direction Z, as shown in FIG. 2 (i.e., perpendicular to coordinate direction Y). This arrangement is beneficial because the smaller cross-sectional area at bottom section 36 of cavity 32 provides a suitable reservoir for fluids while the larger cross-sectional area at top section 47 of cavity 32 is suitable for insertion of larger tools, such as roller brushes.

As further shown in FIG. 2, rim portion 16 includes front edge 48 and rear edge 49, where front edge 48 is adjacent top front section 28 and rear edge 49 is adjacent top rear section 30. Front edge 48 has a lateral extent greater than a lateral extent of rear edge 49, where the lateral extents are taken along coordinate direction Z. Thus, at rim portion 16, cavity 32 generally widens laterally as cavity 32 extends from rear edge 49 toward front edge 48. Moreover, ramp portion 38 of inner surface 26 defines a tray shape that generally widens laterally as ramp portion 38 extends from corner 44 toward front edge 48. The tray shape of ramp portion 38 provides a working surface for tools, such as roller brushes. Ramp portion 38 also includes textured surface 50, which increases the surface friction of ramp portion 38 to remove excess fluids from the tools. Textured surface 50 may comprise, for example, ridges, valleys, bumps, ramps, or a combination thereof on ramp portion 38.

Side rails 42*a* and 42*b* are also useful in conjunction with ramp portion 38. As shown in FIG. 2, roller brush 52 (shown in phantom) may extend within bottom portion 36 of cavity 32, against side rails 42*a* and 42*b*. In this arrangement, end portions of roller brush 52 are disposed against side rails 42*a* and 42*b*, and a central portion of roller brush 52 is exposed adjacent base portion 37. As such, a user may move roller brush 52 along side rails 42*a* and 42*b*, while exposing the entire central portion of roller brush 52 to the fluid contained in cavity 32 (e.g., paint). This increases the amount of fluid that roller brush 52 may collect at a given time. The user may then move roller brush 52 up along ramp portion 38 to remove any excess fluid. As such, container 10 of the present invention is particularly suitable for use with roller brushes.

Container 10 may exhibit a variety of sizes depending on individual needs. In one embodiment of the present invention, ramp portion 38 of container 10 may exhibit a lateral extent along coordinate direction Z ranging about 15 centimeters (cm) to about 18 cm at corner 46. In this embodiment, container 10 is particularly suitable for use with mini-roller brushes, which typically incorporate foam rollers having lengths ranging from about 10 cm to about 13 cm. Ramp portion 38 provides a working surface for the mini-roller brushes to remove excess paint or other fluids.

As further shown in FIG. 2, handle 18 is disposed adjacent top rear section 30 of sidewall 14, and while handle 18 extends above rim portion 16 of container 10, handle 18 does not extend over cavity 32. This relationship is clearly shown in FIG. 2, where handle 18 is shown extending rearwardly relative to cavity 32. This is in contrast to conventional paint containers, which typically include bail-type handles that pivot to remain centered above the center of gravity of the given paint container. When in use, such a handle partially blocks access to the cavity of the given container. Handle 18, however, does not extend over cavity 32, and therefore, does not interfere with the insertion of tools within cavity 32. This is particularly suitable for carrying container 10 with a tool secured to magnet 22. Magnet 22 is positioned within cavity 32 such that when a user holds container 10 by handle 18 or strap 20, the user's hand does not interfere with a tool held by magnet 22. As such, the user may transport container 10 with handle 18 or strap 20 without disengaging the tool from magnet 22.

Figure 3A:
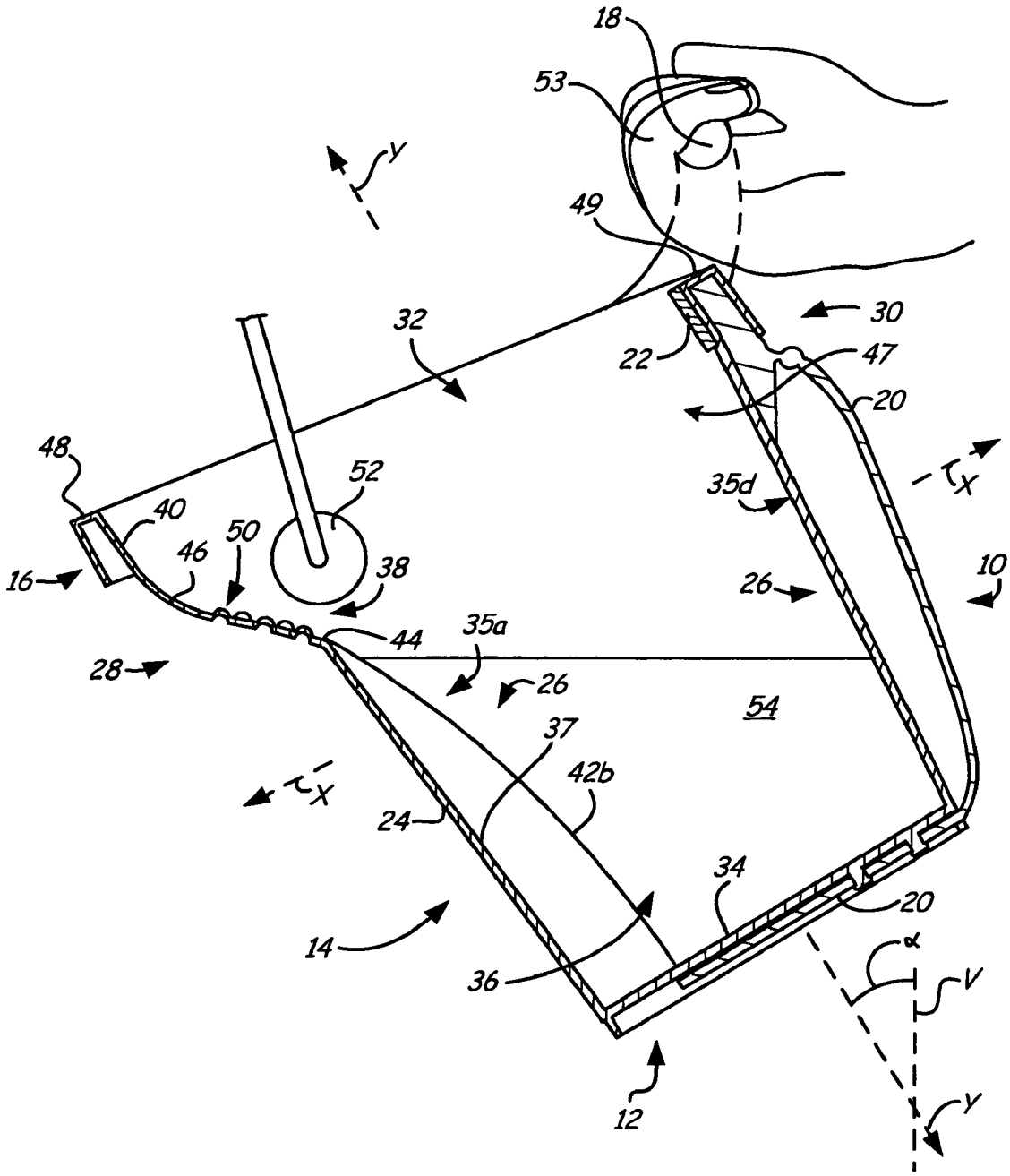
FIG. 3A is a sectional view of the container of the present invention, which is viewed from section 3A-3A in FIG. 2, showing a user holding a handle of the container and inserting a roller brush into the container.
Figure 4:
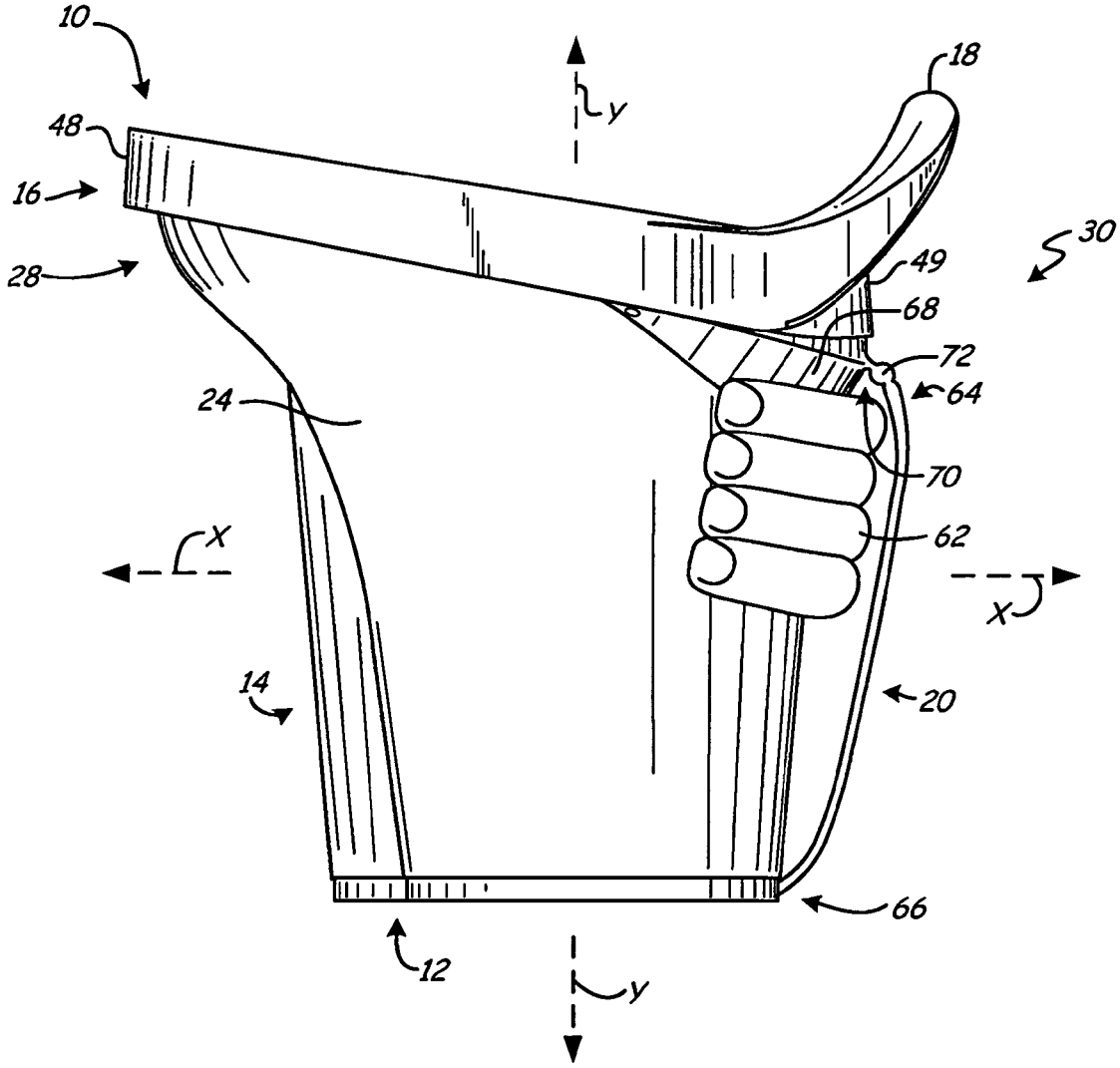
FIG. 4 is a side elevational view of the container of the present invention, showing a user's hand between a strap and an outer surface of the container.
Figure 5:
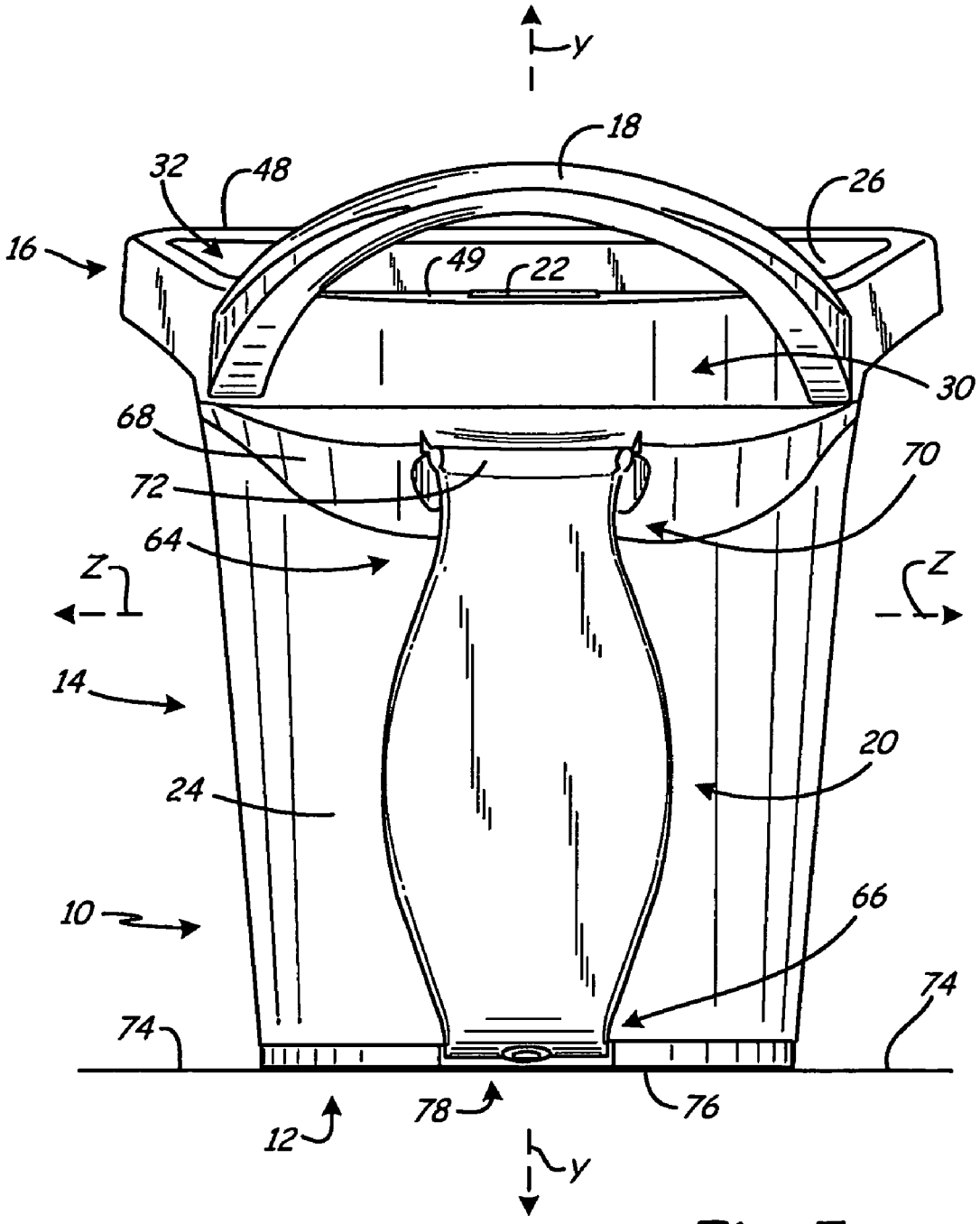
FIG. 5 is a rear elevational view of the container of the present invention.

FIG. 3A is a sectional view of container 10, which is viewed from section 3A-3A in FIG. 2, where container 10 is disposed at a tilted angle when held by a user's hand 53 via handle 18. The process of applying a fluid, such as paint 54, to a desired surface begins by pouring paint 54 into cavity 32 of container 10 (either while container 10 is being held as shown in FIG. 3A or 4, or while container 10 is resting on a generally horizontal surface as shown in FIG. 5). If filled while container 10 is at rest, the user may then grip handle 18 and lift container 10. Because handle 18 is disposed adjacent top rear section 30 of sidewall 14, container 10 tilts from an upright position (see, e.g., FIG. 4) to an orientation at acute angle $\alpha$, where acute angle $\alpha$ is herein measured as an angle between coordinate direction Y of container 10 and vertical line V, as shown in FIG. 3A. Examples of suitable angles for acute angle $\alpha$ range from about 30 degrees to about 60 degrees.

The tilted angle of container 10 provides a beneficial working arrangement for accessing paint 54 within bottom section 36 of cavity 32. To do so, the user may insert a tool, such as roller brush 52, within cavity 32 until roller brush 52 is disposed within paint 54. As discussed above in FIG. 2, the user may move roller brush 52 along side rails 42*a* and 42*b*, while exposing roller brush 52 (and particularly its central portion) to paint 54. As such roller brush 52 follows the contours of side rails 42*a* and 42*b*, rather than the contour of base portion 37. This increases the amount of paint 54 that roller brush 52 may collect at a given time.

When removing roller brush 52 from paint 54, the user may move roller brush 52 up along the gradual angles between side rails 42*a*/42*b* and ramp portion 38, until roller brush 52 is disposed against ramp portion 38. The user may then move roller brush 52 back-and-forth across textured surface 50 of ramp portion 38 to remove excess paint 54 or to uniformly dispose paint across the surface of roller brush 52. As such, ramp portion 38 functions as a paint tray. Lip portion 40 provides a trap to catch excess paint 54, even while container 10 is held at a tilted angle. When roller brush 52 is removed from cavity 32, excess paint 54 that was removed from roller brush 52 is retained within cavity 32 by lip portion 40, and flows back into bottom section 36 of cavity 32. The user may then apply paint 54 to the desired surface with roller brush 52. The use of ramp portion 38, lip portion 40, and side rails 42*a* and 42*b* provide a convenient approach to removing paint 54 from cavity 32 with a tool such as roller brush 52.

The unique design of container 10 makes container 10 a very effective platform for delivering paint 54 (or other fluid). This is due to the increased weight provided by paint 54 in cavity 32, which increases the stability of container 10. For example, when a user moves roller brush 52 along side rails 42*a*/42*b* or along ramp portion 38, the motion of roller brush 52 imparts kinetic energy to container 10. If container 10 does not retain a fluid within cavity 32, the kinetic energy may cause container 10 to sway with the motion of roller brush 52. However, the additional weight of paint 54 (or other fluid) increases the total mass of container 10, reducing the effects of the imparted kinetic energy. As such, when container 10 retains paint 54 within cavity 32, container 10 is relatively stable, and is substantially unaffected by the motion of roller brush 52.

Figure 3B:
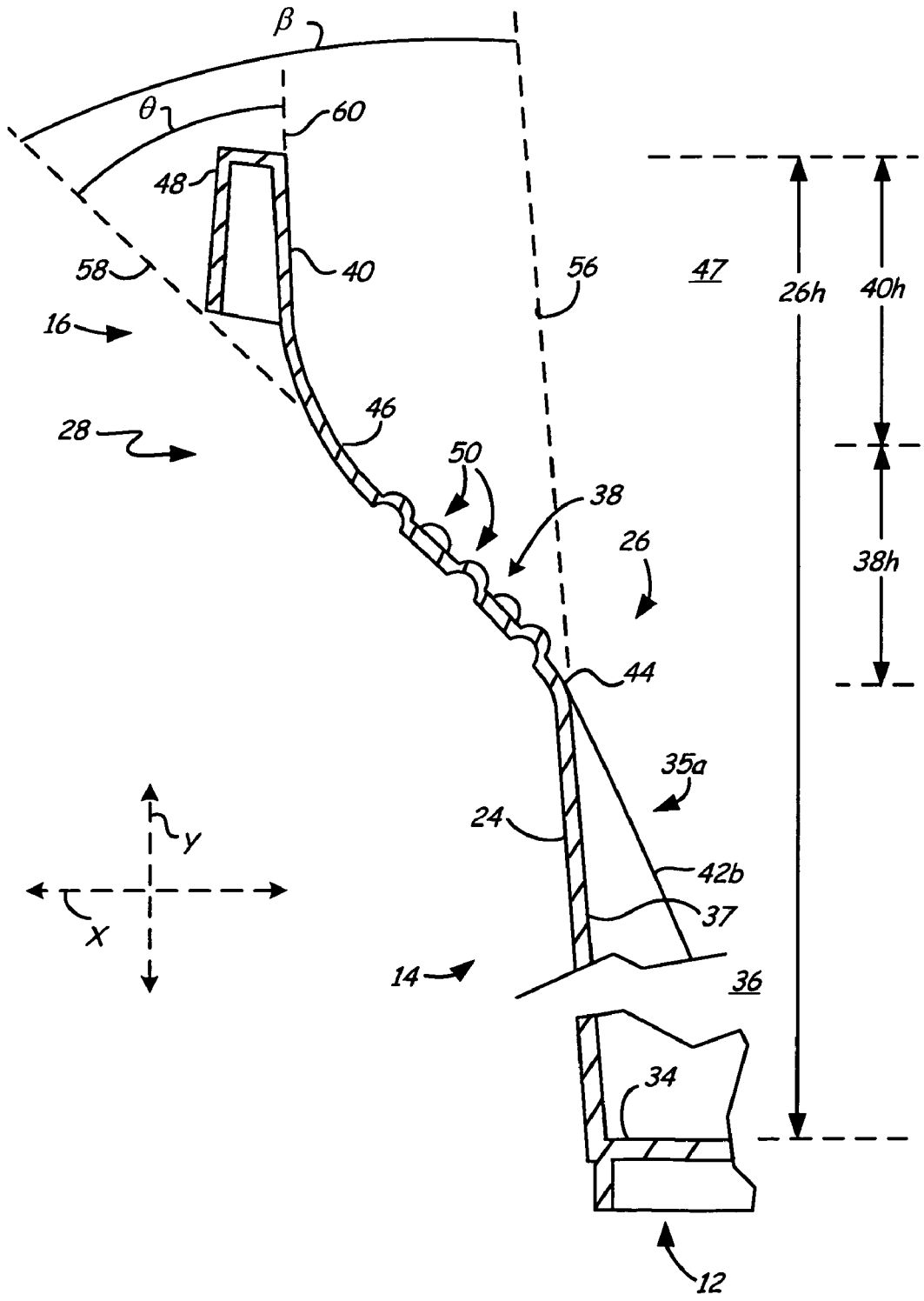
FIG. 3B is an enlarged view of a front portion of the container of the present invention.

FIG. 3B is an enlarged view of the front portion of container 10 in FIG. 3A, and further illustrates the angle between base portion 37 and ramp portion 38 at corner 44, and the angle between ramp portion 38 and lip portion 40 at corner 46. As shown, base portion 37 adjacent a front section of sidewall 14 generally extends along line 56, ramp portion 38 generally extends along line 58, and lip portion 40 generally extends along line 60. In some embodiments of the present invention, one or more of base portion 37, ramp portion 38, and lip portion 40 may exhibit small curvatures. In these embodiments, the respective lines 56, 58, and 60 are tangent to the given curvatures, as taken from respective corners 44 or 46. For example, if ramp portion 38 exhibits a curved surface (either convex or concave), line 58 extends from corner 44 parallel to a tangent line of the curvature of ramp portion 38.

Ramp portion 38 extends from base portion 37 at acute angle $\beta$, where acute angle $\beta$ is herein measured as an angle between line 56 of base portion 37 and line 58 of ramp portion 38, as shown in FIG. 3B. Examples of suitable angles for acute angle $\beta$ range from about 30 degrees to about 60 degrees. In one embodiment of the present invention, acute angle $\alpha$ (discussed above in FIG. 3A) and the acute angle $\beta$ align ramp portion 38 in a substantially horizontal plane when container 10 is freely suspended from handle 18 (as shown FIG. 3A). Extending ramp portion 38 at acute angle $\beta$ from base portion 37 also widens the cross-sectional area of top section 47 of cavity 32 at rim portion 16, which increases accessibility to cavity 32.

Lip portion 40 extends from ramp portion 38 at acute angle $\theta$, where acute angle $\theta$ is herein measured as an angle between line 58 of ramp portion 38 and line 60 of lip portion 40, as shown in FIG. 3B. Examples of suitable angles for acute angle $\theta$ range from about 30 degrees to about 60 degrees. Extending lip portion 40 at acute angle $\theta$ from ramp portion 38 allows lip portion 40 to function as a trap to retain excess fluids (e.g., paint 54) within cavity 32, even when container 10 is held at a tilted angle.

As further shown in FIG. 3B, inner surface 26 of sidewall 12 has height 26*h* along a front section of sidewall 12, ramp portion 38 has a height dimension 38*h*, and lip portion 40 has a height dimension 40*h*, where the heights are herein measured along coordinate direction Y, as shown in FIG. 3B. Examples of suitable combined heights dimensions 38*h* and 40*h* (i.e., the combined heights of ramp portion 38*h* and lip portion 40*h*) range from about 20% of height 26*h* of inner surface 26 to about 50% of height 26*h*, with particularly suitable combined height dimensions 38*h* and 40*h* ranging from about 20% of height 26*h* to about 30% of height 26*h*. Examples of suitable height dimensions 38*h* of ramp portion 38 range from about 10% of height 24*h* of inner surface 26 to about 50% of height 26*h*, with particularly suitable height dimensions 38*h* ranging from about 10% of height 26*h* to about 20% of height 26*h*.

FIG. 4 is a side elevational view of container 10, further illustrating strap 20. Strap 20 is adaptable to accept a user's hand 62 disposed between strap 20 and outer surface 24 of sidewall 14. Strap 20 urges hand 62 against outer surface 24 of the sidewall 14 to secure container 10 to hand 62, and to stabilize container 10 with respect to movement relative to hand 62. Strap 20 desirably exhibits elastic characteristics to provide comfort to hand 62 by conforming to the shape of hand 62 and to help urge hand 62 against outer surface 24 of sidewall 14. Alternatively, strap 20 may accept a user's wrist, arm, or other appendage disposed between strap 20 and outer surface 24 of sidewall 14. Strap 20 may also accept a user's belt (or other clothing item), a ladder, or any suitable structure disposed between strap 20 and outer surface 24 of sidewall 14. Suitable materials for strap 20 include flexible and elastic materials, such as thermoplastic elastomers, rubbers, and other elastic materials. Strap 20 may be elastic along its entire operative length, or merely elastic in part.

Strap 20 includes first end 64 and second end 66, where first end 64 is connected to sidewall 14 adjacent top rear section 30. Second end 66 is connectable to bottom wall 12, as discussed below. In one embodiment, as shown in FIG. 4, sidewall 14 includes inclined section 68 adjacent top rear portion 30. Inclined section 68 extends at an angle from outer surface 24 of sidewall 14, which provides contoured corner 70 at an intersection of inclined section 68 and first end 64 of strap 20. Contoured corner 70 defines an inverted valley between inclined section 68 and strap 20, which comfortably accommodates an uppermost portion of hand 62.

In one embodiment, first end 64 of strap 20 is integrally formed with inclined section 68 via living hinge 72. Living hinge 72 provides additional flexibility between strap 20 and inclined section 68 to increase comfort to hand 62. In this embodiment, strap 20 and inclined section 68 may be separate components from sidewall 14, and are affixed to sidewall 14. In an alternative embodiment, inclined section 68 may be integrally formed as part of sidewall 14, and first end 64 of strap 20 may connect to inclined section 68 in a conventional manner that imparts flexibility.

In use, a user aligns and inserts hand 62 between strap 20 and outer surface 24 of sidewall 14. In this arrangement, strap 20 urges hand 62 against outer surface 24 of sidewall 12, which stabilizes container 10 with respect to movement relative to hand 62. As such, when container 10 is held via strap 20, the orientation of container 10 is determined by the position of hand 62. Container 10 may then be used for dispensing fluids in the same manner as discussed above in FIG. 3A.

FIG. 5 is a rear elevational view of container 10 resting on generally horizontal surface 74, and further illustrates the dimensions of strap 20 and the relationship of handle 18 to cavity 32 of container 10. As shown, strap 20 laterally widens along its length to disperse the pressure exerted by strap 20 on hand 62 (not shown) over a larger area of hand 62. This increases comfort and reduces fatigue while holding container 10 via strap 20.

Additionally, bottom wall 12 includes outer surface 76, which defines groove 78. Groove 78 is an indentation in outer surface 76 through which second end 66 of strap 20 extends through to connect to bottom wall 12. Groove 78 allows strap 20 to extend along bottom wall 12 while allowing container 10 to rest in a stable and upright position on horizontal surface 74.

Figure 6:
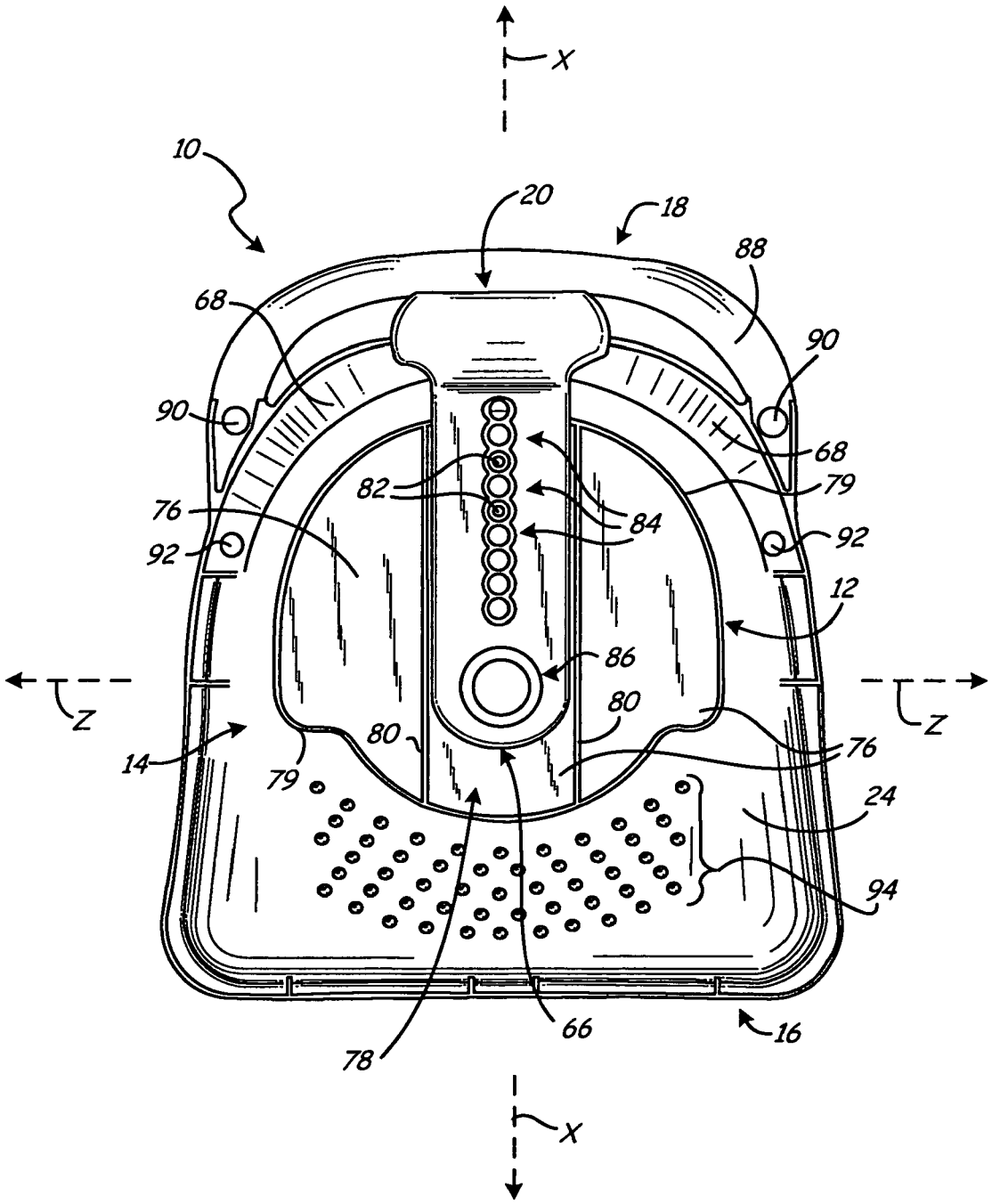
FIG. 6 is a bottom view of the container of the present invention.

FIG. 6 is a bottom view of container 10, further illustrating bottom wall 12 and second end 66 of strap 20. As shown, bottom wall 12 also includes peripheral wall 79, partitions 80, and protrusions 82. Second end 66 of strap 20 includes holes 84 and orifice 86. Peripheral wall 79 of bottom wall 12 is a wall extending generally perpendicularly from outer surface 76, which defines an outer periphery of outer surface 76. Peripheral wall 79 has a generally planar lower edge that allows container 10 to rest in a stable and upright position on generally horizontal surface 74, as discussed above in FIG. 5. Partitions 80 are also walls extending perpendicularly from outer surface 76, and define groove 78. This allows a user to align second end 66 of strap 20 along protrusions 82. In alternative embodiments, partitions 80 may be excluded such that groove 78 extends across the entire area of outer surface 76. Protrusions 82 are tabs extending out from outer surface 76 and function as engagement members for connecting second end 66 of strap 20 to outer surface 76, via holes 84.

Holes 84 are established in an array that extends generally along a portion of the length of second end 66 of strap 20 and provide mating locations for protrusions 82. Orifice 86 is a larger hole in second end 66 of strap 20 suitable for gripping with a finger to disengage second end 66 of strap 20 from outer surface 76. As shown, second end 66 of strap 20 is selectively connectable to outer surface 76 of bottom wall 12 at discreet locations along the length of second end 66 of strap 20. As such, the length of strap 20 is adjustable among several pre-selected lengths.

As further shown in FIG. 6, handle 18 may include bottom surface 88, which is a separately molded portion of handle 18 that is secured to handle 18 at bores 90 via suitable fasteners (e.g., screws). To reduce manufacturing costs and time, handle 18 is preferably formed without a bottom wall, which is typical with conventional molding and casting systems. Bottom surface 88 may then be secured to handle 18 to provide a smooth outer surface around the entire circumference of handle 18. This preserves gripping comfort when a user holds container 10 with handle 18. Bottom surface 88 may also be formed from relatively soft materials, such as the suitable materials for strap 20. This increases the comfort of gripping handle 18.

FIG. 6 also includes bores 92 and dimpled surface 94. Bores 92 are holes in sidewall 14 and inclined section 68, which are used to secure inclined section 68 to outer surface 24 of sidewall 14 via suitable fasteners (e.g., screws). Dimpled surface 94 is a portion of outer surface 24 that is indented during the manufacture of container 10 to provide textured surface 50 of ramp portion 38. Additionally, rim portion 16 further includes an overhang and a plurality of ribs, where the plurality of ribs interconnect sidewall 16 and the overhang.

Figure 7:
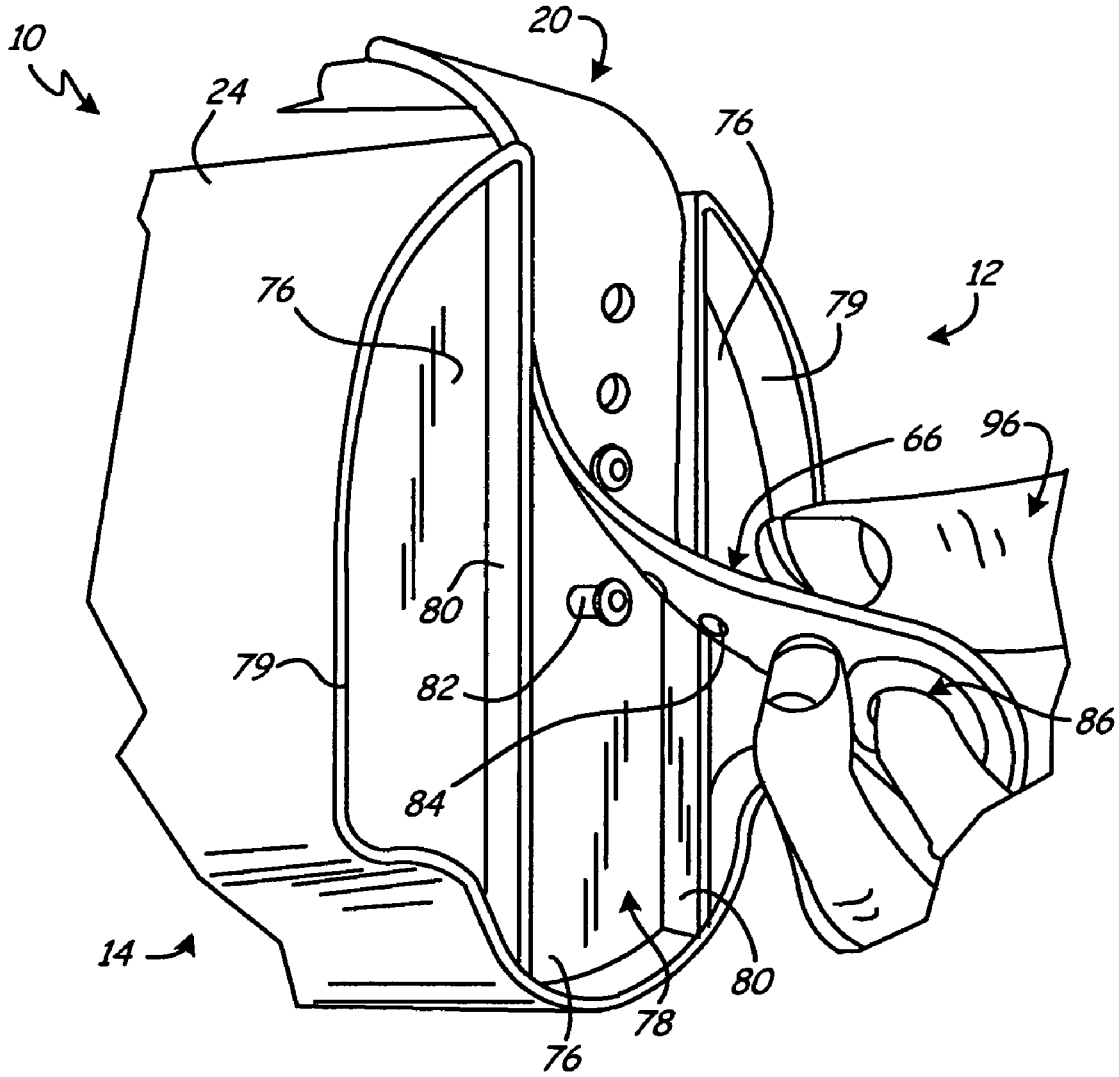
FIG. 7 is an bottom perspective view of the container of the present invention, showing a user selectively securing the strap to an outer surface of a bottom wall of the container.

FIG. 7 is a bottom perspective view of container 10, illustrating an adjustment of strap 20. The length of strap 20 may be adjusted by positioning second end 66 of strap 20 at a desired location along outer surface 76 of bottom wall 12. A user may grip second end 66 of strap 20 with hand 96 and position second end 66 of strap 20 at a pre-selected location within groove 78. Second end 66 of strap 20 is then pressed toward outer surface 76, thereby forcing protrusions 82 through selected holes 84. This secures strap 20 to bottom wall 12 for use.

To remove strap 20 from bottom wall 12, a user may pull second end 66 of strap 20 away from outer surface 76. This may be carried out with the use of orifice 86, where the user inserts a finger of hand 96 through orifice 86 and thereby pulls second end 66 of strap 20 free of protrusions 82. Orifice 86 allows the user to use a greater amount of pulling force to remove strap 20 from bottom wall 12. Accordingly, strap 20 may be adjusted to a plurality of different lengths to accommodate a wide variety of hand sizes.

Strap 20 provides a convenient, stable, secure and effortless way to hold container 10. The user does not need to grip strap 20 or sidewall 14 of the container 10 because strap 20 urges the palm side of a user's hand against outer surface 24 of the sidewall 14 (see FIG. 4). The user can grip sidewall 14 or can merely relax his or her hand during use of container 10, knowing that the container 10 is securely fastened to that hand. This reduces fatigue in the holding hand and fingers of a user.

Figure 8:
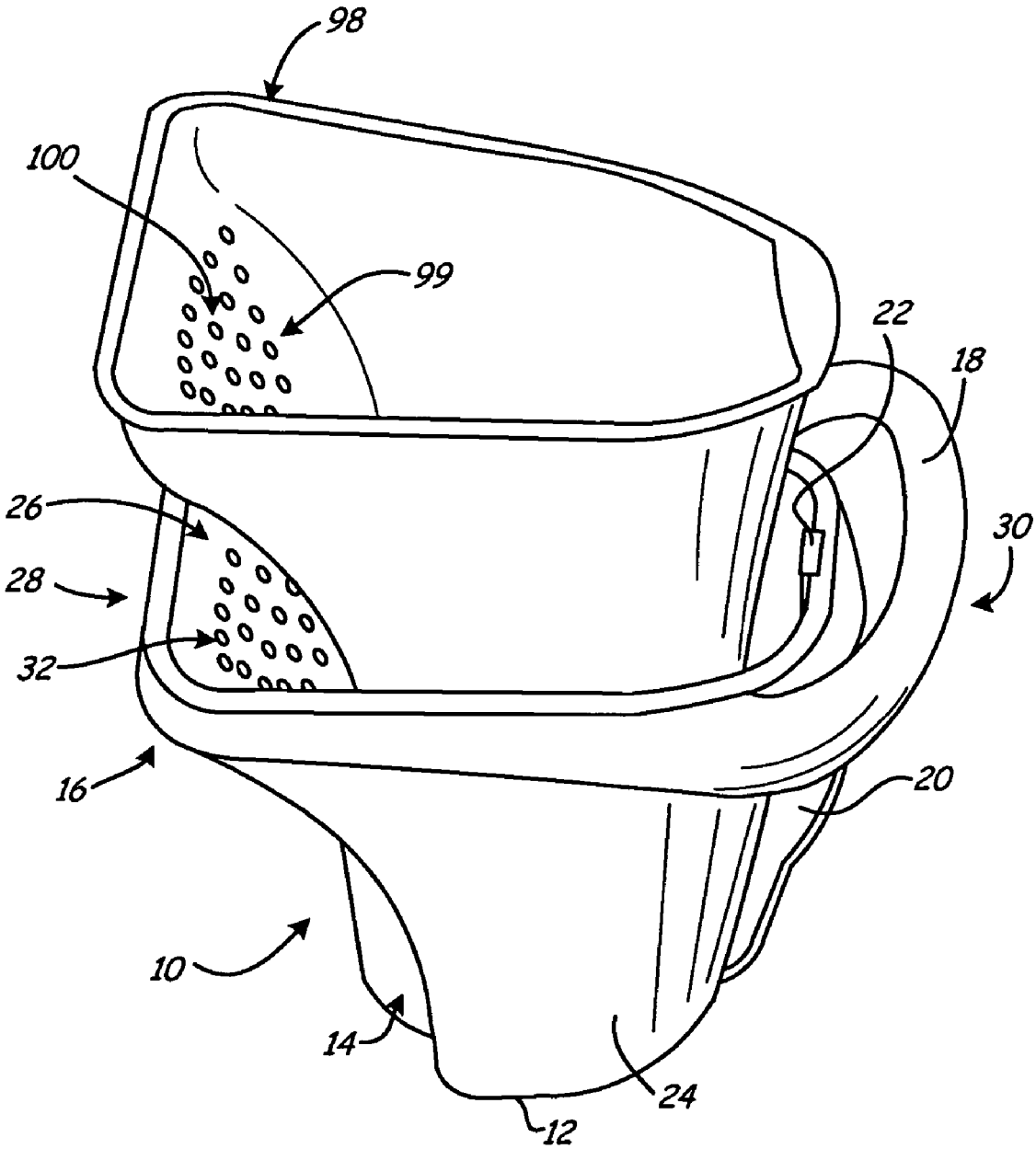
FIG. 8 is a side perspective view of the container of the present invention, showing a liner being inserted into the container.

FIG. 8 is a side perspective view of container 10, showing liner 98 being inserted into cavity 32 of container 10, thereby providing a disposable container to retain fluids. Liner 98 preferably exhibits dimensions that substantially conform to inner surfaces 24 and 34 of container 10 to maximize the usable volume of cavity 32. Liner 98 has a ramp portion 99, which includes textured surface 100 that generally conforms to textured surface 50 of ramp portion 38, and which functions in the same manner as textured surface 50. During a process of applying a fluid to a desired surface, a user may insert liner 98 into cavity 32 of container 10. A fluid, such as paint, may then be poured into liner 98 in cavity 32 of container 10. Container 10 may then be used to apply the fluid in the same manners as discussed above. When completed, the user may discard liner 98. The use of liner 98 substantially prevents fluids, such as paint, from contacting inner surfaces 24 and 34, which decreases time and effort required to clean container 10 after use.

Additionally, cavity 32 of container 10 may be covered with a cap (not shown) to prevent the fluid within cavity 32 from drying or otherwise become contaminated. In one embodiment, the cap may be a flexible plastic film with elastic edges. This allows the cap to wrap around rim portion 16, substantially sealing cavity 32 from external environmental conditions.

Container 10 is a convenient device for retaining, transporting, and dispensing fluids. Container 10 allows a user to alternate between holding container 10 by handle 18 and holding container 10 with strap 20. When held by handle 18, container 10 is oriented at a titled angle, which provides easy access to cavity 32 with tools, and particularly roller brushes (while at the same time presenting ramp portion 38 and side rails 42*a* and 42*b* for use). When held by strap 20, container 10 is stabilized with respect to movement of the user's hand, which also reduces fatigue in the user's arm and hand. In either orientation, a metallic tool may be temporarily fastened to container 10 via magnet 22, and neither handle 18 nor strap 20 interfere with the tool.

Although the present invention has been described with reference to preferred embodiments, workers skilled in the art will recognize that changes may be made in form and detail without departing from the spirit and scope of the invention.

The invention claimed is:

1. A hand-held container for use in retaining, transporting and dispensing fluids including paint, stain, varnish, or combinations thereof, the hand-held container comprising:

a bottom wall having an outer surface and an inner surface;

a sidewall extending from the bottom wall, and having an outer surface, an inner surface, a front section, a rear section, a left section, and a right section, wherein the inner surfaces of the bottom wall and the sidewall define a cavity for retaining the paint, stain, varnish, or combinations thereof, and wherein the inner surface of the sidewall at the front section comprises a ramp portion;

a rigid rim portion extending from the sidewall opposite of the bottom wall to define an opening to the cavity, wherein a front section of the rigid rim portion is located at a greater elevation than a rear section of the rim portion, the elevations being relative to the bottom wall, and wherein the rear section of the sidewall and the rear section of the rigid rim portion are both substantially semi-cylindrical in shape; and a rigid handle loop having a first portion and a second portion, wherein the first portion is integrally connected with and rearwardly projects from the rigid rim portion, wherein the second portion projects upwardly from the first portion such that the rigid handle loop is not disposed over the cavity opening when the outer surface of the bottom wall is on a generally horizontal surface.

2. The hand-held container of claim 1, wherein the ramp portion comprises a textured surface.

3. The hand-held container of claim 1, and further comprising a strap having a first end and a second end, wherein the first end of the strap is securable to the outer surface of the sidewall at the rear section of the sidewall and adjacent to the rigid rim portion.

4. The hand-held container of claim 1, wherein the inner surface of the sidewall at the front section further comprises a base portion extending from the inner surface of the bottom wall, and wherein the ramp portion extends at an acute angle from the base portion.

5. The hand-held container of claim 4, wherein the acute angle aligns the ramp portion in a substantially horizontal plane when the hand-held container is freely suspended by the rigid handle loop.

6. The hand-held container of claim 1, wherein the rigid rim portion comprises an overhang that extends around a portion of the outer surface of the sidewall at least at the front section, the left section, and the right section of the sidewall.

7. The hand-held container of claim 6, wherein the first portion of the rigid handle loop comprises:

a first end of the rigid handle loop, which merges with the overhang of the rigid rim portion adjacent the right and rear sections of the sidewall; and a second end of the rigid handle loop, which merges with the overhang of the rim portion adjacent the left and rear sections of the sidewall.

8. The hand-held container of claim 6, wherein the overhang of the rigid rim portion further extends around a portion of the outer surface of the sidewall at the rear section of the sidewall.

9. A hand-held container for use in retaining, transporting and dispensing fluids including paint, stain, varnish, or combinations thereof, the hand-held container comprising:

a bottom wall having an outer surface and an inner surface;

a sidewall extending from the bottom wall, and having an outer surface, an inner surface, a front section, a rear section, a left section, and a right section, wherein the inner surfaces of the bottom wall and the sidewall define a cavity for retaining the paint, stain, varnish, or combinations thereof, and wherein the inner surface of the sidewall at the front section comprises a ramp portion;

a rigid rim portion extending from the sidewall opposite of the bottom wall to define an opening to the cavity, wherein the rigid rim portion comprises an overhang that extends around a portion of the outer surface of the sidewall at least at the front section, the left section, and the right section of the sidewall the rigid rim portion having a rear section that is substantially semi-cylindrical in shape and the rear section of the sidewall is substantially semi-cylindrical in shape;

a rigid handle loop comprising:

a first end integrally connected with the overhang of the rigid rim portion adjacent the right and rear sections of the sidewall; and a second end integrally connected with the overhang of the rigid rim portion adjacent the left and rear sections of the sidewall, wherein the first and second ends of the rigid handle loop project rearwardly from the rigid rim portion, wherein the rigid handle loop further projects upwardly from the first and second ends and is not disposed over the cavity opening when the outer surface of the bottom wall is on a generally horizontal surface.

10. The hand-held container of claim 9, wherein a front section of the rigid rim portion is disposed higher than a rear section of the rigid rim portion when the outer surface of the bottom wall is on a horizontal surface.

11. The hand-held container of claim 9, wherein the rigid rim portion further comprises a plurality of ribs interconnecting the sidewall and the overhang of the rigid rim portion.

12. The hand-held container of claim 9, wherein the ramp portion comprises a textured surface.

13. The hand-held container of claim 9, and further comprising a magnet secured to the inner surface of the sidewall at the rear section of the sidewall and adjacent to the rigid rim portion.

* * * * *